United States Patent [19]

Larkin

[11] 4,331,232

[45] May 25, 1982

[54] SOAP DISH

[76] Inventor: Mark E. Larkin, 419 Northgate, Lindenhurst, Ill. 60046

[21] Appl. No.: 124,063

[22] Filed: Feb. 25, 1980

[51] Int. Cl.[3] ..... A47K 5/08

[52] U.S. Cl. ..... 206/77.1; 206/565

[58] Field of Search ..... 206/77.1, 559, 561, 206/565

[56] References Cited

U.S. PATENT DOCUMENTS

| | | | |
|---|---|---|---|
| 570,666 | 11/1896 | Huebel | 206/77.1 |
| 1,554,832 | 9/1925 | Antelmann | 206/77.1 |
| 2,504,536 | 4/1950 | Kisselburg | 206/77.1 |
| 2,842,893 | 7/1958 | Howerton | 206/77.1 |
| 2,879,622 | 3/1959 | Graziano | 206/77.1 |
| 2,908,995 | 10/1959 | Seamon | 206/77.1 |
| 3,019,549 | 2/1962 | Evans | 206/77.1 |
| 4,133,443 | 1/1979 | Medina | 206/77.1 |

*Primary Examiner*—Joseph Man-Fu Moy

*Attorney, Agent, or Firm*—Neil E. Hamilton

[57] ABSTRACT

A one-piece soap dish which can be molded as a single part yet will permit the lifting of projectable portions by movement of a tab portion so that a soap bar can be lifted and tilted from the dish. The lifting of the projectable portions is provided by an integral hinge which is placed between the tab portion and the floor. The one-piece soap dish can be molded with an integral bottom drip tray as well as wall members to provide a confinement for the soap.

10 Claims, 10 Drawing Figures

SOAP DISH

BACKGROUND OF THE INVENTION

This invention relates to a one-piece receptacle for a bar of soap which will permit the soap to be easily removed therefrom. More particularly, this invention relates to a one-piece soap dish which can be molded as a single part yet provide an integral hinging action so as to permit the upward movement of projecting portions by the downward movement of an integral tab portion with the consequent lifting of a bar of soap.

Soap trays or dishes of the type concerned with in this invention are described in U.S. Pat. Nos. 570,666; 1,554,832; 2,504,536; 2,842,893; 2,879,622; 2,908,995 and 3,019,549. All of the soap trays or holder devices described in these patents are multicomponent units fabricated from several parts requiring separate forming of the parts and subsequent assembly. For example, U.S. Pat. Nos. 570,666; 1,554,832 and 2,842,893 illustrate soap trays wherein a separate wire lift member is provided for lifting the soap from a support member. The remaining patents show even more complex soap trays which would necessitate the fabrications of several components and assembly thereof, thus requiring substantial cost.

The prior art nowhere teaches a soap dish with a soap removal feature which can be fabricated in one piece and also obviate further assembly. Neither is there available a low-cost soap dish with an integral hinging action which will permit the lifting of certain integral portions of the dish to serve as removal projections in conjunction with a tab portion. The prior art provides multicomponent soap removal trays with no provision for a soap dish which can be injection molded from a plastic resinous material and further formed, if desired, as part of a retention or shelf structure.

It is an advantage of the present invention to provide a one-piece soap dish with a soap removal feature. Other advantages are a one-piece soap dish which can be molded at low cost from a resinous plastic material; a one-piece soap dish with a soap removal feature having a unique integral hinge action, and a soap dish which can be molded with an integral drip tray and/or shelf structure.

SUMMARY OF THE INVENTION

The foregoing advantages are attained and the shortcomings of the prior art are overcome by the present one-piece soap dish wherein there is provided a floor portion with at least two upwardly extending stationary rib members. At least one projectable portion is integrally formed in the floor portion and normally lies in the same plane as the floor and below the rib members. A tab portion is also integrally connected to the projectable portion in the floor. A hinge section is integrally placed between the tab portion and the stationary rib members in the floor. When a downward force is exerted on the tab portion, an upward force is transmitted to the projectable portion to contact the piece of soap lying on the rib members and causes it to be lifted therefrom and into a person's hands. The one-piece soap dish is injection molded with no further need of fabrication, and it can be formed with a lower drip tray. The one-piece soap dish can be molded as a separate unit of various geometric configurations and can also be formed as a part of a shelf unit.

BRIEF DESCRIPTION OF DRAWINGS

A better understanding of the present soap dish will be had by reference to the drawings wherein.

DESCRIPTION OF THE PREFERRED EMBODIMENTS

Figure 3:
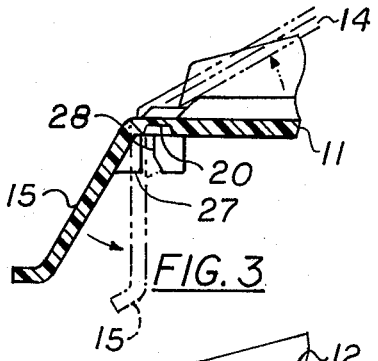
FIG. 3 is a view in vertical section taken along line 3—3 of FIG. 2.
Figure 1:
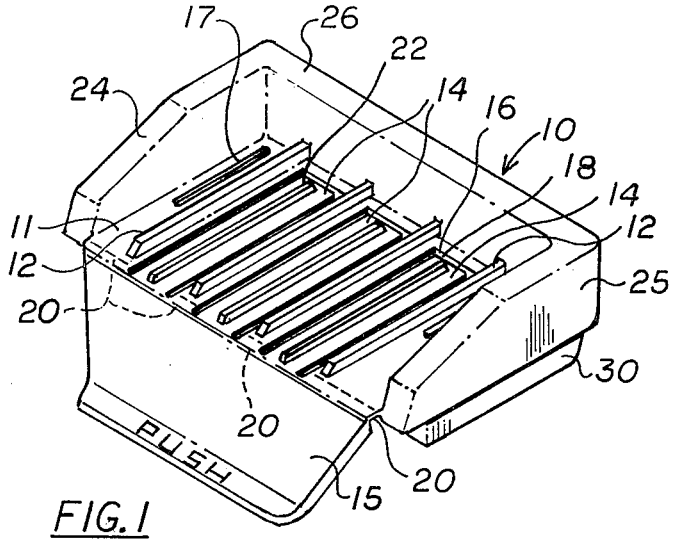
FIG. 1 is a perspective view of one embodiment of the one-piece soap dish.
Figure 4:
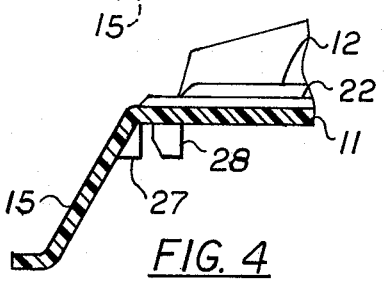
FIG. 4 is a view in vertical section taken along line 4—4 of FIG. 2.
Figure 2:
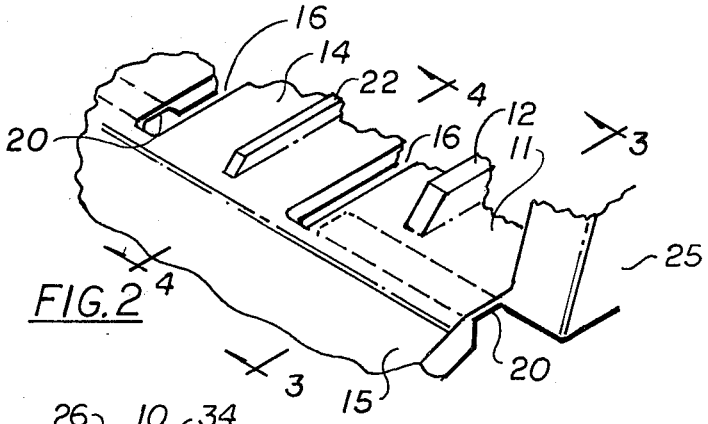
FIG. 2 is a partial elevational view of the soap dish of FIG. 1 illustrating the hinging section.

Proceeding to a detailed description of the invention, one of the embodiments is indicated by the numeral 10 and is particularly shown in FIGS. 1–7. It includes a floor portion 11 with rib members 12 extending upwardly therefrom. Also forming a part of floor portion 11 are projectable portions 14 which are integrally connected to a push tab portion 15 and have upwardly extending ribs 22. Hinge sections 20 are also formed in floor 11 and are disposed between rib members 12 and push tab 15. It will be noted that projectable portions 14 are formed in floor 11 by means of longitudinal slots 16 which are joined at the ends opposite tab 15 by a transverse slot 18. These slots 16 and 18, in addition to allowing the projectable portions 14 to move upwardly when tab 15 is moved downwardly, also permit drainage of water from soap such as 40. In addition, drainage slots 17 are also disposed in floor 11. As best shown in FIGS. 3 and 4, stop members 28 and 27 extending from floor 11 and tab portions 15, respectively, prevent excessive inward bending of tab 15.

Figure 5:
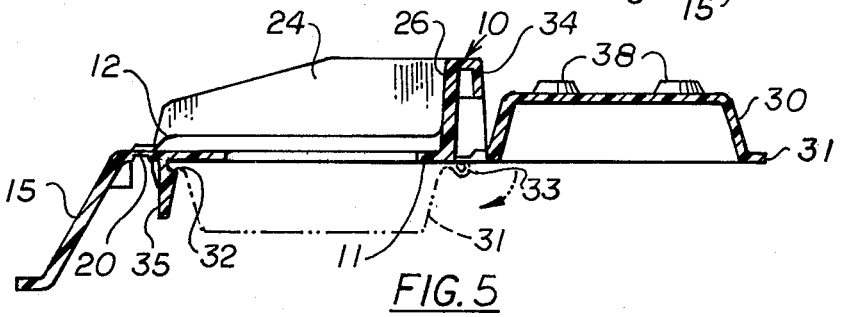
FIG. 5 is a view in vertical section illustrating the one-piece soap dish with the hinged drip tray and showing the unit immediately after it is molded.
Figure 6:
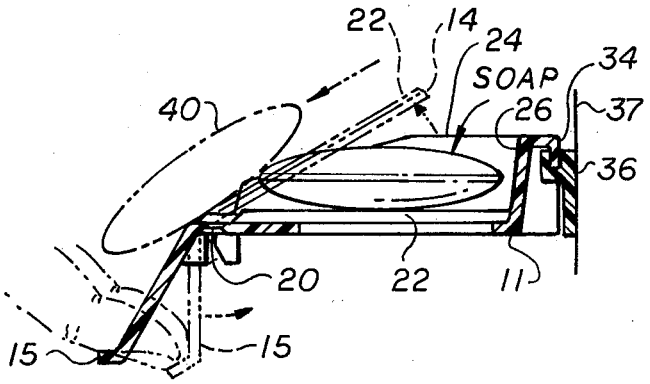
FIG. 6 is a view in vertical section of the soap dish of FIG. 1 attached to a wall bracket and illustrating a soap bar being removed therefrom by the hinging action of the tab portion and the lifting of a projectable portion.
Figure 7:
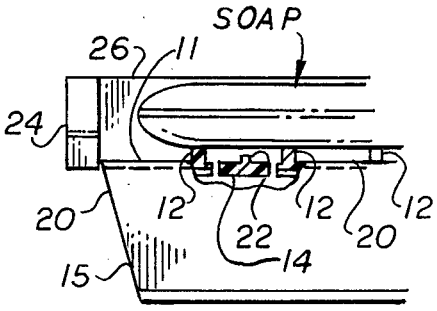
FIG. 7 is a front elevational view of the soap dish of FIG. 6 showing the soap supported therein.

In order to retain a bar of soap on dish 10, side walls 24 and 25 joined by back wall 26 extend upwardly from floor 11. As indicated in FIG. 5, a drip tray 30 can be molded integrally with dish 10 and pivotally attached thereto as by means of hinge 33. Tray 30 is secured under dish 10 by means of flange 31 engaging groove 32 of flange 35 extending downwardly from floor 11. Feet 38 provide a desired standoff and can be of the friction engaging type. Extending from back wall 26 is a hook section 34 for attachment to wall bracket 36 of bathroom wall 37.

Figure 9:
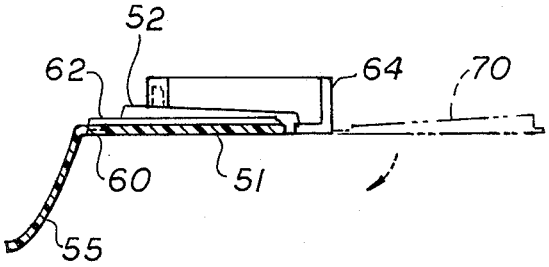
FIG. 9 is a partial view in vertical section of the soap dish unit shown in FIG. 8.
Figure 8:
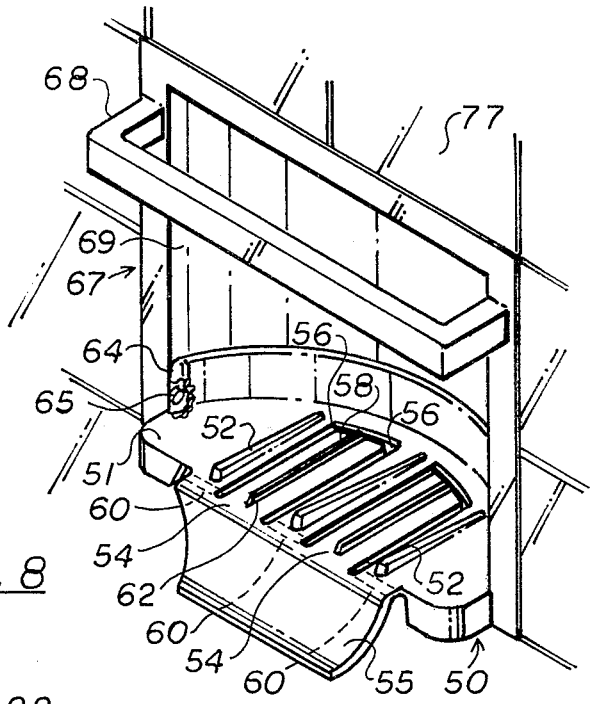
FIG. 8 is a perspective view of another embodiment illustrating the soap dish formed with curved retaining wall for purposes of being accommodated in a shower or bathtub wall fixture.

As shown in embodiment generally 50 of FIGS. 8 and 9, the unitary soap dish also has the previously described floor portion 51 as in embodiment 10 with rib members 52 extending upwardly therefrom. Projecting portions 54 are also formed in floor 51 by means of longitudinal slots 56 and transverse slot 58. Ribs 62 are provided on projecting portions 54. Tab portion 55 is integrally connected to floor 51 and hinge sections 60 are disposed opposite rib members 52. A curved retaining wall 64 extends upwardly from floor 51 and is designed to be accommodated within the curved wall 69 of fixture 67 which has the usual handle 68 and fits within an accommodating opening in bathroom wall 77. If desired, a drain tray 70 can be pivotally attached to floor 51 and secured in the manner described for unit 10 and tray 30. This is best seen in FIG. 9.

Figure 10:
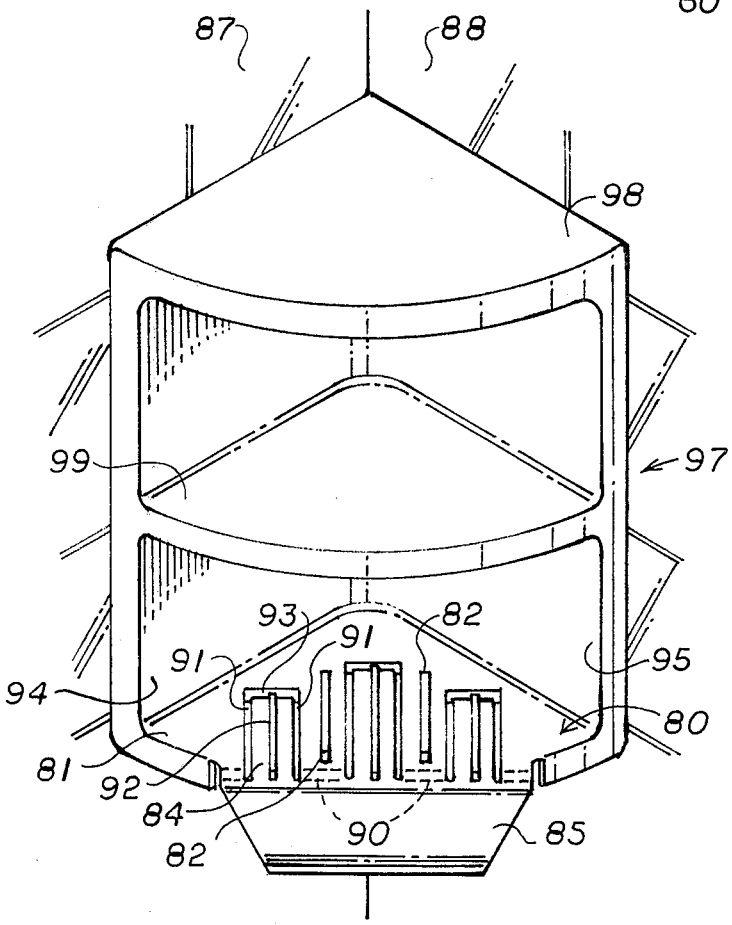
FIG. 10 is a perspective view of a still further embodiment showing the soap dish as a part of a shelf structure.

As illustrated in FIG. 10, soap dish generally 80 also includes a floor portion 81 with integral ribs 82. Projectable portions 84 are provided in floor 81 by means of longitudinal slots 91 and transverse slot 93. A rib 92 extends from the projectable portions 84. However, as in the other embodiments, it will not extend upwardly as far as ribs 82 so that in a non-operating position, the soap will normally rest on ribs 82. Hinge sections 90 are disposed in floor 81 and interconnect with push tab 85 adjacent ribs 82. In this particular embodiment, soap dish 80 forms a part of a shelf unit generally 97 which includes side walls 94 and 95 with a top wall 98 and intermediate shelf 99. Shelf unit 97 is secured to bathroom walls 87 and 88 in the usual manner.

OPERATION

A better understanding of the advantages of the soap dish units 10, 50 and 80 will be had by a description of the manufacture and operation. Referring first to unit 10, it should be pointed out that all of the component portions such as the floor 11, projectable portions 14, walls 24, 25 and 26 as well as tab portion 15 can be easily injection molded as one integral unit. The hinge sections 20 are formed in floor 11 between tab 15 and stationary ribs 12 as part of the molding operation. Preferably, drip tray 30 will be formed as a part of the soap dish during the molding operation. After molding, it will be noted that except for snap-fitting tray 30 under floor 11 by engagement of flange 31 in groove 32, no assembly of soap dish unit 10 is required. Dish 10 will be placed in a convenient place such as in a wall opening and a bar of soap placed therein. As will best be seen in FIG. 7, the soap will be supported on stationary ribs 12 and projectable portions 14 will be in the same general plane as floor 11. In this manner, ribs 22 of projectable portions 14 are out of contact with soap 40. When it is desired to remove the soap from tray 10, all that is required is a downward and inward movement of tab 15 as best illustrated in FIG. 5. This movement will cause projectable portions 14 to raise in a counterclockwise movement with a consequent lifting of soap 40 until it reaches a point where it will slide off portions 14 and into one's hand. Upon release of the force on tab 15, the tab 15 and projectable portions 14 will assume their original positions due to the plastic memory of hinge sections 20.

It will be appreciated that the lifting of projectable portions 14 when tab 15 is moved in the previously described manner is effected by the placement of hinge sections 20 which are in four separate locations. Hinge sections are not placed between tab 15 and projectable portions 14. Accordingly, tab 15 and projectable portions 14 will act as one integral entity whereas tab 15 will pivot independently of floor 11 in the area of hinge sections 20. It will be further appreciated that projectable portions 14 are separated from floor 11 by means of slots 16 and 18 so that they can move independently therefrom and as a part of tab 15. These slots 16 and 18 also afford a drainage means in conjunction with slots such as 17. With ribs 22 of projectable portions 14 located below the upper surface of ribs 12, the projectable portions will be out of contact with soap 40 until it is desired to lift the soap. This feature prevents the sticking of soap to the projectable portions and thus affords ready release.

The operation of units 50 and 80 with respect to the hinging and lifting of the projectable portions 54 and 84 are the same as described for unit 10. Soap dish 80 offers the advantage that not only can it be molded in one piece with respect to the bottom dish portion but also as a part of a shelf unit 97. Regarding unit 50, it can be molded to fit into an existing fixture 67 and can be suitably anchored therein such as by means of pins 65 extending into the ends of curved wall 64.

Soap dish units 10, 50 and 80 are molded, such as injection molding, from a plastic resinous material and preferably polypropylene. However, other plastics such as ABS and engineering resins could be used. The depth of the floor and the thickness of the tab are preferably 0.063" whereas the hinge sections are preferably 0.020" thick.

As mentioned earlier, the soap dish units can be formed with integral drip trays such as 30 and 70. However, this is optional and could be eliminated as could the retaining feet 38 and the supporting hook 34. While a multiplicity of alternating arranged stationary rib members and projectable portions are preferred, the novel hinging and lifting action of the invention can be accomplished by two rib members with the projectable portion placed therebetween.

It will thus be seen that through the present invention there is now provided a one-piece, integrally molded soap dish which requires no assembly of parts. The soap dish affords a lifting and ready removal action for a piece of soap by a unique hinging arrangement. Several options for the dish units are easily provided, such as a drip tray and a hanging hook. In addition, the one-piece soap removal dish can be molded to be used by itself, as part of a fixture or as part of a shelf unit.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A one-piece soap dish which can be molded and utilized without an assemblage of parts comprising:

a floor portion defining at least two upwardly extending stationary rib members;

at least one projectable portion having an upper surface integrally formed in said floor portion by means of slots integrally molded through said floor portion and adjacent said rib members;

a tab portion integrally connected to said projectable portion, and a hinge section integrally connecting said tab portion with said floor portion adjacent said stationary rib members, said upper surface of said projectable portion normally lying in a plane below said rib members so that when a downward force is exerted on said tab portion, an upward force will be transmitted to said projectable portion to contact said piece of soap and cause it to be lifted from said rib members and into a person's hand.

2. The one-piece soap dish as defined in claim 1 wherein said projectable portion includes an upwardly extending rib member.

3. The one-piece soap dish as defined in claim 1 wherein said floor portion defines a multiplicity of rib members and a multiplicity of projectable portions are alternately arranged with respect to said stationary rib members.

4. The one-piece soap dish as defined in claim 1 further including opposing side wall members and a back wall member extending upwardly from said floor portion, said back wall member positioned opposite said tab portion.

5. The one-piece soap dish as defined in claim 1 further including a continuous curved wall member extending upwardly from said floor portion and spaced from said tab portion.

6. The one-piece soap dish as defined in claim 1 wherein said floor portion is of a generally triangular configuration and forms a portion of a housing structure, said structure including two side wall members extending upwardly from said floor portion and spaced from said tab portion, said structure further including a shelf and a top member spaced from said floor portion and extending in planes generally parallel thereto.

7. The one-piece soap dish as defined in claim 1 further including a tray member integrally formed with and hinged to said floor portion opposite said tab portion, and means operatively associated with said tray member and said floor to lock said tray member beneath said floor.

8. The one-piece soap dish as defined in claim 7 wherein said locking means is defined by a flange extending from said tray member opposite said hinge and an accommodating groove formed in a flange extending downwardly from said floor.

9. The one-piece soap dish as defined in claim 4 wherein said back wall member further includes a hook-like member for attachment with a support member.

10. The one-piece soap dish as defined in claim 1 wherein all of said portions and sections are formed from a polypropylene resin material.

* * * * *